US006018217A

United States Patent [19]

Fondrk

[11] Patent Number: 6,018,217

[45] Date of Patent: Jan. 25, 2000

[54] CRT FUNNEL WITH COMPLIANT CORNERS AND CRT ENVELOPE INCORPORATING SAME

[75] Inventor: Mark T. Fondrk, Villa Park, Ill.

[73] Assignee: Zenith Electronics Corporation, Glenview, Ill.

[21] Appl. No.: 07/885,107

[22] Filed: May 18, 1992

[51] Int. Cl.[7] ..... H01J 29/01

[52] U.S. Cl. ..... 313/477 R

[58] Field of Search ..... 313/477 R, 408; 220/2.1 A

[56] References Cited

U.S. PATENT DOCUMENTS 3,161,314 12/1964 Pfleeger et al. ..... 220/2.1 A 4,686,416 8/1987 Dougherty et al. ..... 313/408

*Primary Examiner*—Sandra O'Shea

[57] ABSTRACT

Accelerated thermal upshock rates in the exhaust cycle of a CRT envelope are attained for CRTs, and especially a tension mask CRT having a shadow mask-supporting rail frame affixed to a flat, skirtless front panel. The corner walls of the CRT funnel are made with thinner walls to provide an increased compliance of the normally very rigid corners of the funnel-to-panel seal area. Panel-fracturing stresses generated in the funnel-to-panel seal area corners during upshock are thus alleviated allowing for faster CRT throughput during manufacture.

8 Claims, 3 Drawing Sheets

FIG 4
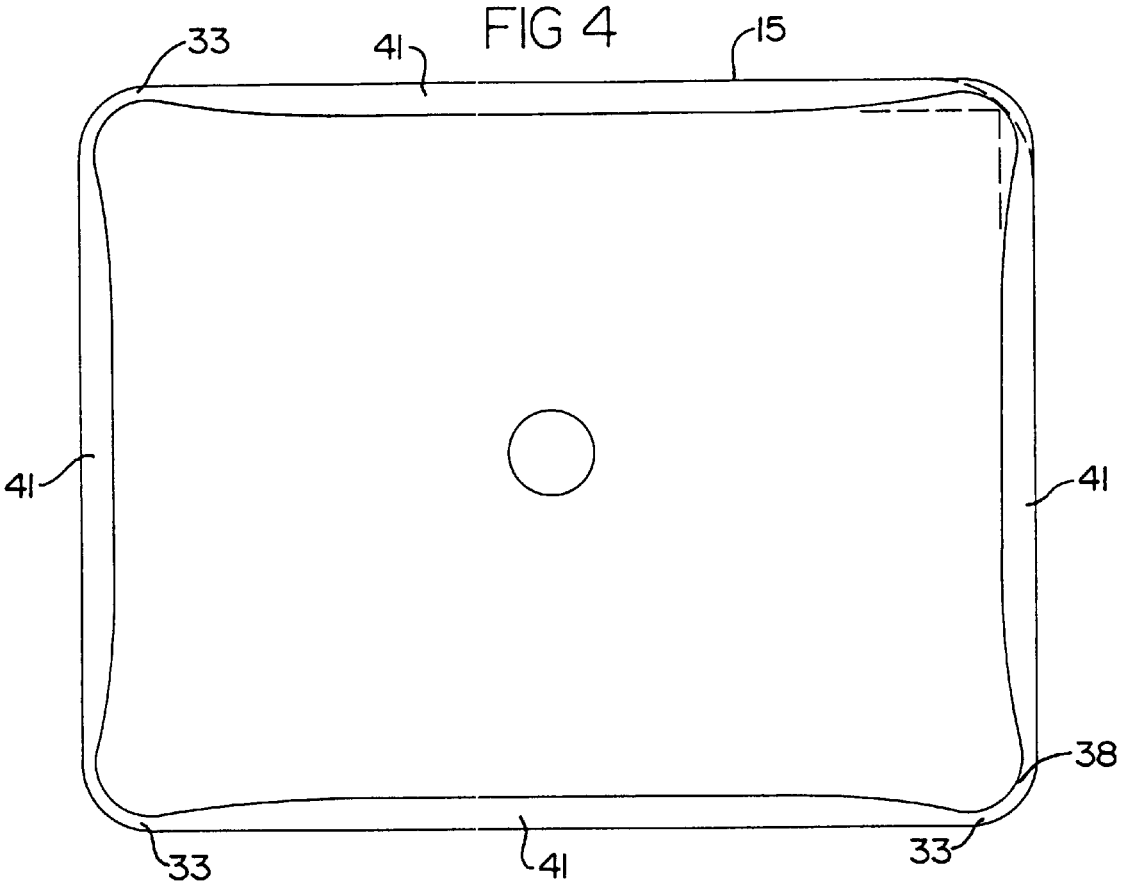
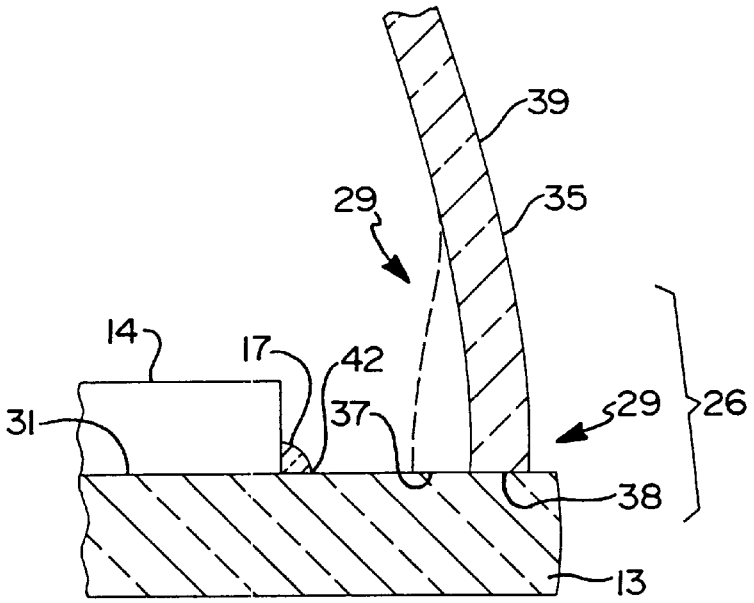
FIG 5

CRT FUNNEL WITH COMPLIANT CORNERS AND CRT ENVELOPE INCORPORATING SAME

CROSS REFERENCE TO RELATED APPLICATIONS

The present invention is related to, but not dependent on copending U.S. application Ser. No. 815,675, Filed Dec. 13, 1991, commonly owned herewith.

BACKGROUND OF THE INVENTION

1. Field of the Invention

The present invention relates generally to CRTs having front panels with tensioned shadow masks affixed thereto by means of panel-mounted mask support structures. More specifically the present invention relates to a funnel design for speeding the exhaust cycle during manufacture of these CRTs without increasing stress fractures in the funnel to panel seal area.

2. Discussion of the Related Art

As seen in FIG. 1, a known flat tension mask (FTM) CRT envelope 11, as made by the assignee of the present invention, comprises a substantially rectangular flat, skirtless, glass front panel 13 and a substantially conical glass funnel 15 hermetically sealed together. The funnel 15 and panel 13 are joined by application of heat to a cementious material 17, which is a television grade devritrifying solder glass, known in the art as frit. Shadow mask support structures, or rails, 14 are affixed to the panel 13 by frit 17 and form a substantially rectangular mask-support frame 14 (FIG. 2) to support a tensed shadow mask 16 welded thereto. Extending from the funnel 15 is a glass neck 19 into which is hermetically sealed an electron gun 21 by fusing the neck glass thereto. The envelope 11 is evacuated through a tube 23 extending through the gun 21 and the tube 23 is sealed, completing an evacuated and operational CRT. Operational components not necessary to a disclosure of the present invention have been omitted but will be understood by the artisan to be present.

In the evacuation procedure, or "exhaust cycle", the envelope 11 is hooked to vacuum plumbing (not shown) and traversed through a lehr, or oven, having sections of successively higher temperatures. The heat is required to drive contaminants inside the bulb eg. water, into vaporous states so that they may be withdrawn from the envelope by the vacuum apparatus and a sufficient vacuum may be obtained. Heat is applied from the outside of the envelope and, therefore, a thermal gradient between the inside and outside of the envelope is established which stresses the envelope.

If the envelope is heated too rapidly during evacuation, the envelope may crack due to the stresses generated in the envelope. This envelope failure is very costly since the envelope is very nearly a completed cathode ray tube at this stage of its manufacture. In order to avoid catastrophic failure of the envelope the evacuation procedure is slowed so that the envelope is not thermally stressed to a level higher than it can safely maintain.

In larger sized flat tension mask bulbs which utilize thicker glass in the envelope, especially in the faceplates, the thermal gradients can become more severe, thus aggravating the above-discussed failure rate versus exhaust time conditions. By attaining a desired accelerated upshock rate consistent with a low envelope failure rate and the minimum heating time needed to achieve a hard vacuum in the tube, a faster evacuation cycle with reduced envelope failure would result in manufacturing savings by reducing equipment and energy requirements while resulting in higher yields.

The present invention addresses the above-discussed problems by structuring the funnel wall in the seal land area so as to reduce the chance of envelope failure and/or to accelerate the envelope evacuation procedure.

BRIEF DESCRIPTION OF THE DRAWINGS

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

FIG. 4 is a front end elevation of a CRT funnel according to the present invention illustrating the novel funnel-to-panel seal area thereof.

FIG. 5 is a cross-sectional view of a corner portion of a CRT envelope funnel-to-panel seal area according to the present invention.

DESCRIPTION OF THE PREFERRED EMBODIMENTS

The preferred embodiment will be discussed in relation to a fourteen inch flat tension mask (FTM) cathode ray tube (CRT) with a pressed glass faceplate of 0.520 inch thickness and a known funnel with a seal land thickness of 0.460 inch as may be found on a FTM CRT computer monitor model #1492 sold by Zenith Electronics Corp., the assignee hereof.

Figure 1:
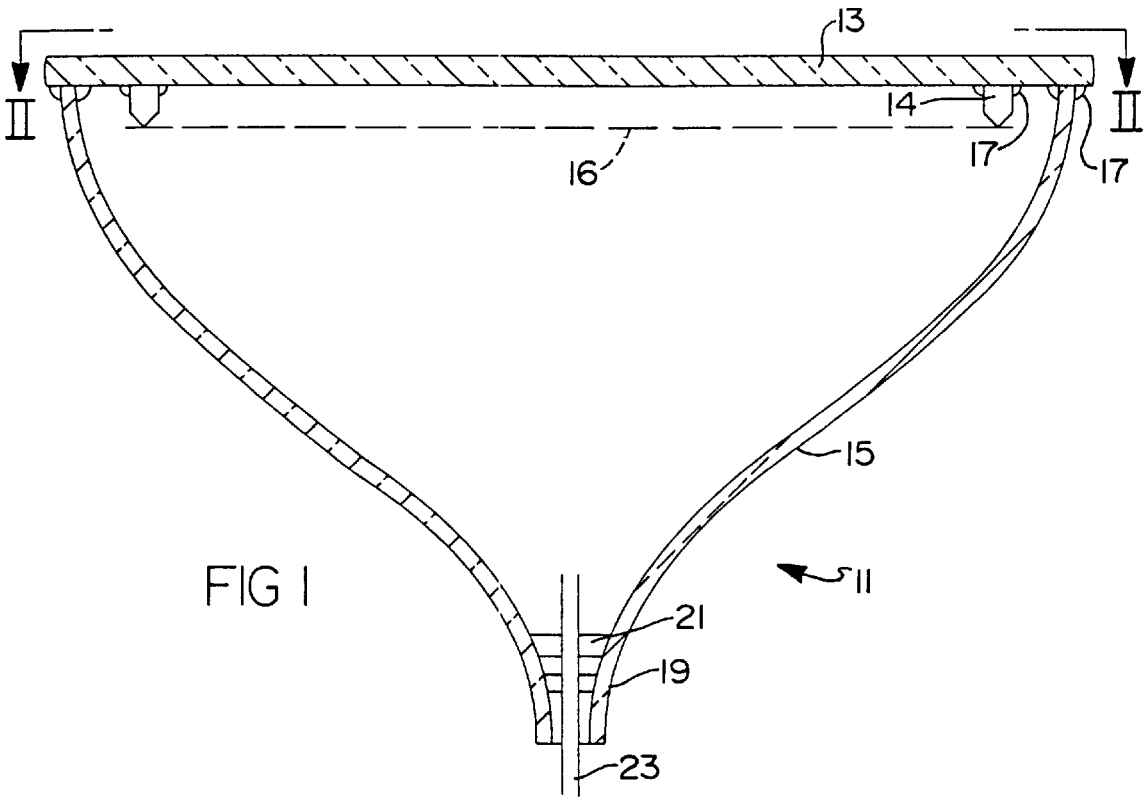
FIG. 1 is a cross section of a tension mask CRT envelope prior to evacuation of the envelope.
Figure 2:
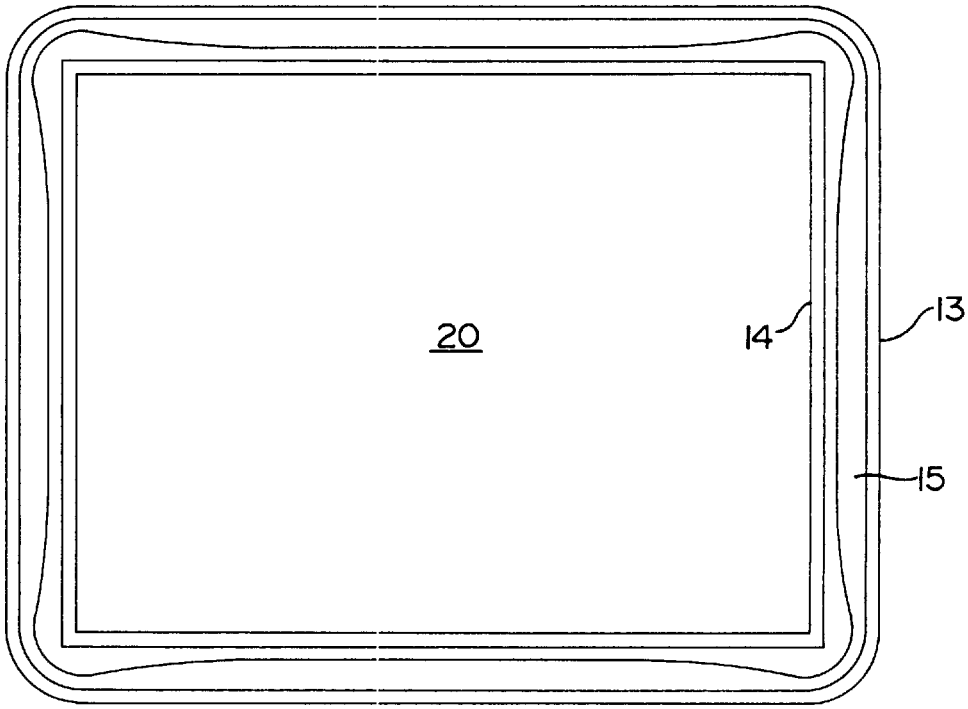
FIG. 2 is a front view of the tension mask CRT according to the present invention.

As seen in FIG. 2., the funnel 15, when affixed to the panel 13, closely surrounds the mask support structures 14. Such an arrangement gives the largest viewing screen area for the smallest overall envelope size. The mask support structures 14, in turn, closely surround the screen 20. Due to the unique flatness of the panel 13 and the attachment of the rigid mask support structures 14 to the panel, the flat tension mask (FTM) envelope is susceptible to stress-induced failures at the funnel-to-panel seal area, hereinafter funnel seal area 26. During thermal processing, such failures are especially likely to originate at the seal area corners 29, as further explained below.

Figure 3:
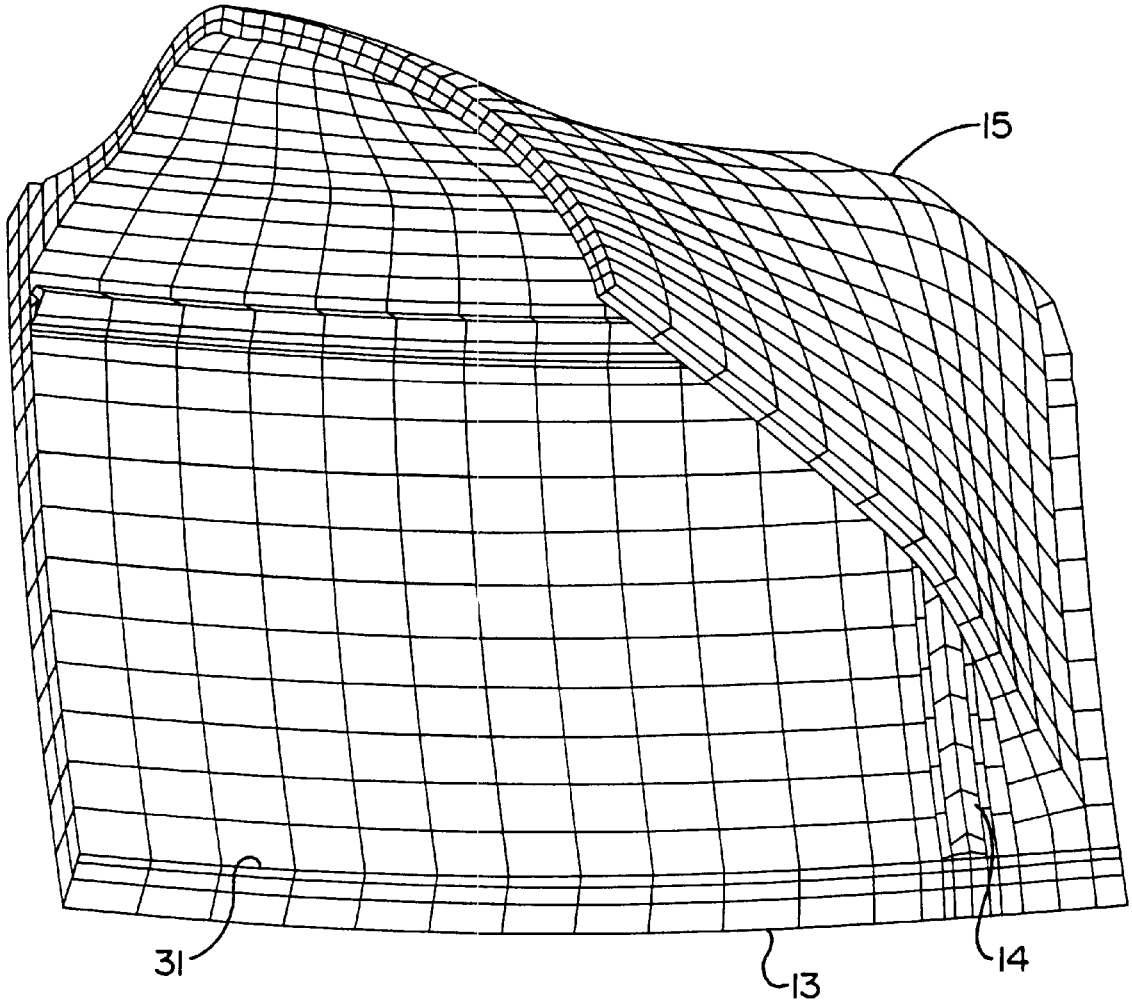
FIG. 3 illustrates the deformation of the CRT envelope corner panel-to-funnel seal area during exhaust cycle upshock.

During the exhaust cycle "up-shock", i.e. rising temperature phase, the panel stresses are primarily driven by the thermal gradient through the panel. As seen in FIG. 3., this gradient causes the panel 13 to deform spherically. If the panel 13 were unrestrained, this deformation would not be accompanied by high panel stresses. However, the funnel 15 tries to resist the panel deformation, thereby applying a bending moment to the panel 13. The bending moment produces tensile stresses on the inside surface 31 of the panel.

These panel surface stresses are highest in the corners 29, because the funnel 15 is stiffest in the corners 29, thereby presenting the most resistance to panel deformation. Because the funnel 15 is less stiff along the sides, the stresses of the panel inner surface 31 quickly decrease in all directions going away from the corners 29.

The mask supports, or rails 14, are attached to the inside surface of the panel 13, with frit 17. The edge of the frit "bead" meets the panel surface 31 at a re-entrant angle 42, creating substantial stress concentrations. The stress concentration magnifies the already high stresses produced by the funnel restraining the panel's thermal deformation. The location of these stress concentrations coincides with the point where failure initiates during accelerated thermal upshock.

Therefore the thermal stresses during evacuation on the CRT envelope 11 may be lessened by providing more compliant funnel corners 33 to decrease the resistance to panel deformation at the sensitive corner areas.

As seen in FIGS. 4 & 5 this compliance can be achieved by reducing the thickness of the funnel seal area funnel wall 35 at the funnel corners 33, until sufficient compliance is achieved for rapid upshock without adversely affecting the evacuated envelope pressure strength.

Typically, as seen in FIG. 5 for a known 14" diagonal measure FTM, the seal area wall 35 (as shown in phantom) is substantially equal in width to the thickness of the front panel 13 at its end 37, or junction, with the panel. The seal area funnel wall 35 must therefore taper from a thickness of approximately two hundred mils (hundredths of an inch) in the upper wall area 39 to a thickness of four hundred to five hundred mils a its end 37. According to the present invention, the funnel wall 35 would be made thinner at the corners 33, for example retaining a constant thickness of two hundred to three hundred mils from the upper wall area 39 through the lower wall area 40 all the way to the end 38.

As seen in FIG. 4, the normally designated axes of a CRT envelope are indicated for descriptive purposes.

As seen in FIG. 5 the funnel wall 35 should be adequately faired along the Z axes from the upper wall area 39 into the lower wall area 40 to avoid abrupt transitions. Likewise in FIG. 4 the transitions from the corner walls 33 to the side walls 41 should also be adequately faired in the X-Y plane.

Narrowing the funnel wall thickness at the funnel corners 33 will not adversely effect evacuated bulb strength as long as the side walls 41 are left substantially the same thickness as in the known funnel.

Such a funnel construction has the further advantage of easier funnel fabrication in that less glass must be forced to the far reaches of the funnel mold during fabrication.

Further advantages of the present invention include the provision of extra clearance space between the funnel and the mask support structure. The need for such clearance may be entirely spatial, if as shown in FIG. 2, the mask support structure is a closed frame 12, or also may be needed to move the funnel corners away from the stress-riser points of the mask support frames. This advantage derives from radiusing the corners on the interior surface of the funnel wall corners 33, as best seen in FIG. 4, rather than leaving the wall interior corners square and radiusing the walls from the outside as shown in phantom in the upper right hand corner of FIG. 4.

It will therefore be seen that by appropriately thinning the funnel walls at the funnel corners, this more compliant funnel will allow the facepanel to undergo less thermal stress during evacuation, whereby CRT throughput may be increased during the exhaust cycle, thus providing economies in the manufacturing process.

While the present invention has been illustrated and described in connection with the preferred embodiments, it is not to be limited to the particular structure shown, because many variations thereof will be evident to one skilled in the art and are intended to be encompassed in the present invention as set forth in the following claims:

What is claimed is:

1. A cathode ray tube (CRT) funnel having walls ending in a substantially rectangular seal area for joining to a CRT front panel, the funnel characterized in that corner areas of the funnel walls in said seal area are substantially thinner than the funnel walls in the non-corner areas of the rectangular seal area, thereby providing a more compliant funnel corner when the funnel is joined to the front panel.

2. A CRT envelope comprising:

a) a funnel having walls ending in a substantially rectangular seal area for joining to a CRT front panel, the funnel further having corner areas of the funnel walls in said seal area that are substantially thinner than the funnel walls in the noncorner areas of the rectangular seal area, thereby providing a more compliant funnel corner when the funnel is joined to the front panel, and b) a flat front panel affixed to said funnel.

3. The CRT envelope of claim 2 wherein the front panel is skirtless.

4. The CRT envelope of claim 3 further characterized in that the flat, skirtless panel has an interior surface, an exterior surface and, a) a phosphor screen on the interior surface thereof, b) a mask support structure affixed to the interior surface and surrounding the phosphor screen, and c) a tensed shadow mask affixed to the mask support structure.

5. In a substantially conical cathode ray tube (CRT) funnel having a substantially rectangular end portion for affixation to a CRT front panel, the end portion having side walls and corner area walls and an interior and exterior surface each defining a substantially rectangular shape in the X-Y plane of the funnel, the improvement comprising:

the corner walls being of thinner dimension than the side walls by virtue of having the interior surface of said corner walls being moved outwardly of the normally defined substantially rectangular shape towards said exterior surface.

6. The CRT funnel of claim 5 further characterized in that the interior surface of said corner walls are curved outwardly towards said exterior surface.

7. The CRT funnel of claim 6 further characterized in that the corners walls are faired at their transitions into the side walls.

8. The CRT funnel of claim 5 further characterized in that the upper areas of the corner walls are faired at their transitions with the lower areas of the corner walls.

* * * * *